United States Patent [19]

St. Claire, Jr.

[11] 3,940,131

[45] Feb. 24, 1976

[54] BATTING PRACTICE DEVICE

[76] Inventor: Ebba J. St. Claire, Jr., 52 Champlain Ave., Whitehall, N.Y. 12887

[22] Filed: Oct. 8, 1974

[21] Appl. No.: 513,176

[52] U.S. Cl. ..... 273/26 R; 273/29 A

[51] Int. Cl.[2] ..... A63B 69/40

[58] Field of Search ..... 273/26 R, 26 E, 29 A, 25, 273/95 A, 191 R, 191 A

[56] References Cited

UNITED STATES PATENTS

| | | | |
|---|---|---|---|
| 2,985,452 | 5/1961 | Trippet | 273/26 R |
| 3,139,282 | 6/1964 | Lande | 273/26 R |
| 3,386,733 | 6/1968 | Russo et al. | 273/26 R |
| 3,489,411 | 1/1970 | Morelli et al. | 273/26 R |
| 3,762,705 | 10/1973 | Gonzales | 273/26 R |

FOREIGN PATENTS OR APPLICATIONS

| | | | |
|---|---|---|---|
| 117,888 | 12/1943 | Australia | 273/29 A |

*Primary Examiner*—Richard J. Apley
*Assistant Examiner*—T. Brown
*Attorney, Agent, or Firm*—Cushman, Darby & Cushman

[57] ABSTRACT

A batting practice device is provided for assisting a hitter in determining whether or not his swing is level and achieving a level swing at balls located at various positions relative to the strike zone. A pair of elongated vertically spaced horizontally extending arms are provided, the lower arm having a member associated therewith for supporting a practice baseball to be hit. The arms are supported on a vertical support member, and adjustment structure is provided for allowing positioning of the practice ball in any position relative to the strike zone. Base members for supporting the vertical support may be in the form of homeplates, and structure may be provided for rotating the arms about the vertical support to allow cooperation of the arms with either of the plates whereby the device may be used by both left-handed and right-handed batters.

10 Claims, 2 Drawing Figures

Fig. 1.
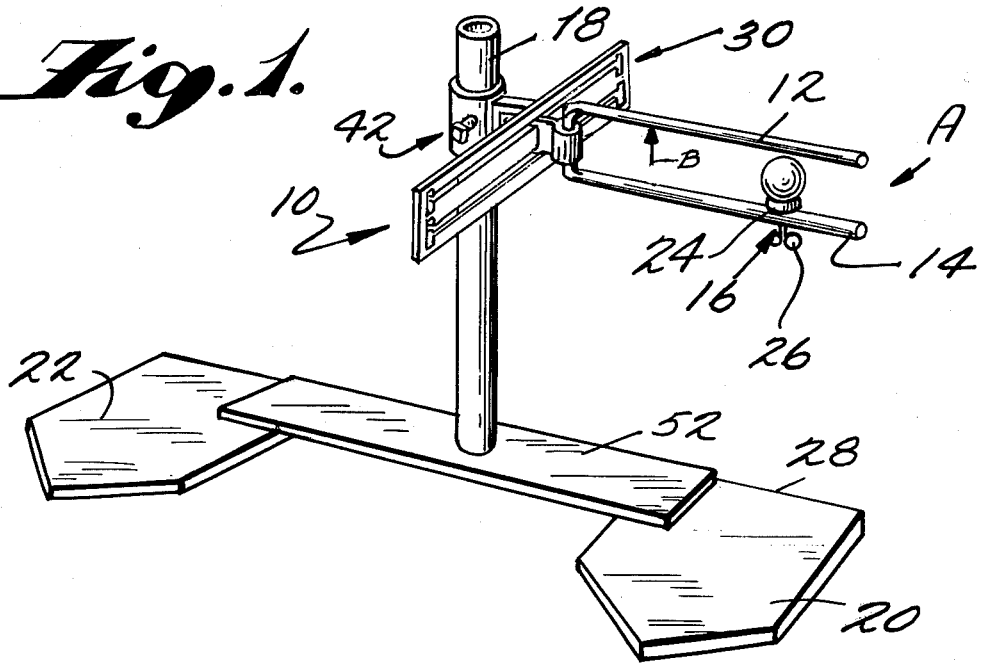
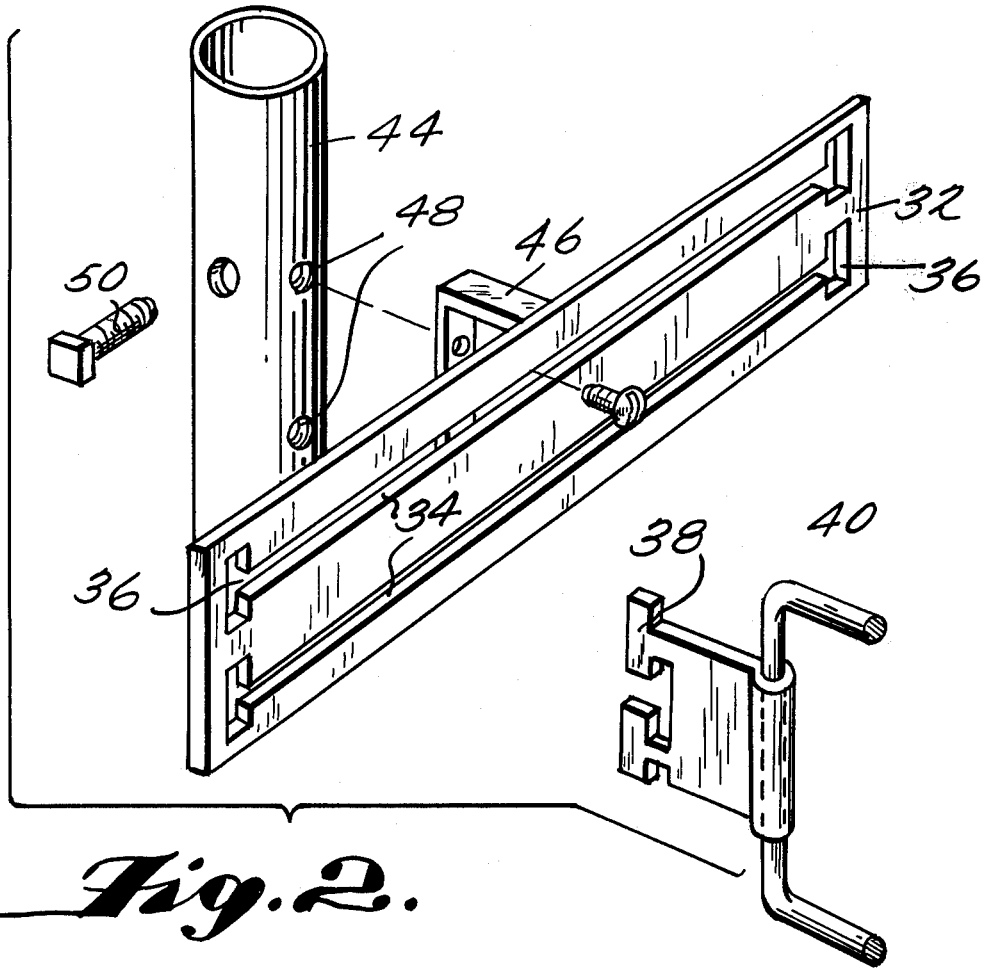
Fig. 2.

BATTING PRACTICE DEVICE

BACKGROUND AND SUMMARY OF THE INVENTION

The invention relates to a device for assisting a baseball player in practicing his swing and for ensuring that the swing is proper. It is well known in the sport that for a player to achieve maximum benefit from his power in hitting a ball that his swing be level. Many players have a level swing when a ball is pitched within some areas of the strike zone while they have a tendency to "chop" or "undercut" a ball in other areas of the strike zone. The invention provides a means for allowing a player with practice to achieve a level swing in all areas of the strike zone.

There have been many prior art devices that have been proposed for assisting a baseball player in practicing his swing. For instance U. S. Pat. Nos. 3,139,282 and 3,489,411 show means for supporting a baseball at various parts of a home plate-shaped base to allow a batter to strike the ball at various positions that cause him difficulty. Such devices while giving a batter a realistic feel in hitting a ball have no means for ensuring that the batter's swing is level at the various areas of the plate on which the ball is supported. Thus a batter will not get the maximum benefit of the practice of hitting the ball since he will not be able to determine whether or not his swing is level.

U.S. Pat. Nos. 2,985,452, 2,443,131 and 3,386,733 disclose prior art proposals for providing means for assisting a player in developing a level swing. These devices are not entirely successful in accomplishing this objective, however, because they do not provide for realistic contact with a baseball, nor do they provide for adjustability depending upon the areas relative to the strike zone a player is having difficulty maintaining a level swing in. U.S. Pat. No. 2,985,452 for instance provides only level guides for allowing movement of a bat therebetween, and no perspective is provided for various areas of the strike zone, no ball is hit, and the bars unnecessarily require that a player's swing remain level from start to finish instead of just requiring that it be level in the area of contact with the ball, which is all that is necessary or desirable. U.S. Pat. Nos. 2,443,131 and 3,386,733 also do not provide for realistic hitting of a ball, other materials being provided to simulate the hitting of a ball; also again no perspective relative to a plate is provided, nor is adjustment possible horizontally relative to a plate.

According to the teachings of the present invention an improved batting practice device is provided that ensures that a player's swing is level at the point of contact with a baseball while not unnecessarily restricting the swing at other portions thereof, provides for realistic hitting of a baseball to ensure proper feel, and allows adjustment of the point of placement of a practice ball to be hit both horizontally and vertically relative to a reference home plate and associated strike zone for both right-handed and left-handed hitters, while providing a device that is easy and inexpensive to manufacture. The exemplary device according to the present invention provides a pair of spaced horizontally-disposed parallel arms having means for holding a ball associated with the bottom one thereof. These arms may be mounted to a plate having a track therein providing for adjustment of the arms in one horizontal plane, while the ball-holding means provide for adjustment of the ball placement in another horizontal plane perpendicular to the above-mentioned plane. The plate may be mounted on a sleeve which sleeve is in turn mounted on a pole and adapted to be vertically adjusted with respect thereto. The pole may be attached to two home-plate base members which provide support for the device as a whole and also a reference for facilitating proper adjustment of a practice ball to be hit within various areas of a strike zone. The sleeve may be rotatable with respect to the pole so that the arms may extend over either of the two base home-plates, thus allowing practice by either a right-handed or left-handed batter.

It is the primary object of the present invention to provide an improved batting practice device. This and other objects of the invention will become clear from an inspection of the detailed description of the invention and from the appended claims.

BRIEF DESCRIPTION OF THE DRAWINGS

FIG. 1 is a perspective view of an exemplary batting practice device according to the present invention; and FIG. 2 is an exploded detail perspective view of portions of the device shown in FIG. 1 with portions thereof cut away.

DETAILED DESCRIPTION OF THE INVENTION

Exemplary apparatus according to the present invention is shown generally at 10 in the drawings. In general said apparatus includes a pair of parallel horizontally extending vertically spaced elongated relatively rigid arms, upper arm 12 and lower arm 14. The arms are "open" (that is have no vertically extending member therebetween) at end A thereof and are spaced a vertical distance B, the distance B being somewhat greater than the width of the bottle portion of a conventional baseball bat. Attached to the lower arm 14 is a member 16 adapted to hold a baseball or the like thereon between the arms 12 and 14. As shown the member 16 comprises a cup-shaped flexible member, but it may take other forms. The arms 12 and 14 are supported in their generally horizontal position by a vertically extending support member, such as post 18.

In order to provide practice for a hitter having trouble maintaining a level swing at various portions of the strike zone, the apparatus 10 is provided with a number of means for adjusting the position of a baseball or the like supported by the means 16 relative to the ground and relative to a reference home-plate (such as home-plate base members 20 and 22). Such adjustment means include an adjustable coupling for attaching the cup member 16 to the lower arm 14, such as a collar 24 and thumb screw 26 therein, whereby adjustment of the location of a baseball or the like relative to a home-plate 20 along the direction of elongation of arm 14 is provided. The degree of adjustment of the cup member 16 with respect to the arm 14 preferably corresponds to the width (17 inches) of the front edge 28 of home-plate 20 so that the batter will also be taught to swing at balls only within the strike zone. Adjustment outside this area may also be provided, however, if desired.

Another means 30 provides for adjustment of the arms in the horizontal direction perpendicular to the front edge 28 of plate 20 so that balls either in front of or behind edge 28 may be practice hit (preferably adjustment is limited to 3 inches in front of home-plate edge 28 and 9 inches in back of it to again simulate game best pitch conditions). The means 30 preferably includes a plate 32 having a pair of horizontal grooves 34 formed therein. Each end of each groove may be terminated by an enlarged portion 36. The grooves 34 are adapted to receive tab portions 38 of a vertically extending connecting member 40 for the two arms 12 and 14. The groove portions 34 and 36 are so dimensioned that the vertical dimension of the tabs 38 is greater than the width of the grooves 34 but that the dimension of the enlarged portions 36 are greater than those of the tabs 38, whereby the arms may be disconnected from the plate 30, facilitating replacement with new or differently dimensioned arms.

A means 42 provides for adjustment of the arms 12, 14 vertically with respect to the post 18, and additionally may provide for rotation of the arms with respect to the post 18. The means 42 preferably includes a sleeve member 44 having substantially the same inside diameter as the outside diameter of the post 18. The sleeve 44 is operatively attached to the plate 32, as by bracket 46 and screws (not shown) passing through bracket 46 and threaded into holes 48 in sleeve 44. A thumb-screw 50 or other suitable means may be provided for locking the sleeve 44 in various positions with respect to the post 18. As can be readily seen the arms 12, 14 may be rotated about post 18 as allowed by sleeve 44 (after loosening of thumb-screw 50) so that the arms may cooperate with either plate 20 or plate 22.

As has been previously stated the members 20 and 22 are base plate members having the same size and dimension as a baseball home-plate, and they are orientated in the same direction. Each plate 20, 22 is spaced via cross-piece 52 from the vertical post 18 so that a batter practicing hitting a ball at the far end of the strike-zone will not hit the post 18. The base members may be merely placed on the ground, or affixed to the ground by any suitable means (depending upon the ground surface) such as spikes or suction cups on the bottom of plates 20 and 22.

Operation of the apparatus shown in the drawings is as follows: A hitter loosens thumb screw 50 of sleeve 44 and rotates the arms 12 and 14 about post 18 so that they are parallel to the front edge (i.e., edge 28) of either plate 20 or plate 22 depending upon whether the hitter is left-handed or right-handed. The hitter then (A) adjusts the horizontal position of the arms 12, 14 in the direction perpendicular to the front edge of the plate 20 or 22 by sliding the member 40 with respect to the plate 32, (B) adjusts the vertical position of the arms 12, 14 by adjusting the sleeve 44, and (C) adjusts the position of the cup member 16 with respect to the arm 14 by loosening the thumb-screw 26 — depending upon the position of pitches that the particular hitter is having trouble meeting properly with a level swing. After proper adjustment, a regulation baseball, rubber-coated ball, whiffle ball of baseball dimensions, or the like is placed on the cup member 16, the batter stands in the position he would normally take when going up to bat (that is within a batter's box, and the particular position therewithin where he feels most comfortable), and the batter swings at the ball. If the swing is level, the bat will properly pass between the arm members 12 and 14 and solidly meet the ball — if the swing is not level it will hit one or both of the arm members 12, 14 and the ball will not be met solidly. With constant practice in this manner, the batter will learn to swing level at balls at any portion of the strike zone.

While the invention has been herein shown and described in what is presently conceived to be the most practical and preferred embodiments, it will be obvious to those of ordinary skill in the art that many modifications may be made thereof within the scope of the invention. For instance other means, such as C-collars or interference fits, may be provided for providing adjustment between the various members for proper location of a baseball. Also a single home-plate base member maybe provided, the member being able to be flipped over about its operative attachment to post 18 for allowing use by either a right-handed or left-handed batter and anchorage of the device could be provided by other means (although anchorage by the pair of home-plates is in all probability superior). Also, arms 12, 14 could extend from either side of the post 18 so that there would be no need for rotation of the arms about the post 18 to cooperate with either plate 20 or 22, although this would add to the expense of the device. The arms 12 and 14 maybe coated with a soft material to protect them and the bat, and may be made flexible in the horizontal plane. Other modifications are also possible, thus it is intended that the appended claims be accorded their full scope so as to encompass all equivalent structures and devices.

What is claimed is:

1. A batting device comprising means for assisting a baseball player in developing a level swing of a conventional baseball bat, said means including a pair of elongated generally horizontally extending vertically spaced parallel arms including an upper arm and a lower arm, said arms being vertically spaced a distance sufficient to allow the passage of the bottle-shaped portion of a horizontally disposed conventional baseball bat therebetween, said arms substantially lying in a single vertical plane, said arms having no vertically extending connecting member at at least one of the ends thereof thereby forming an open end, means located on said lower arm for supporting a baseball between said arms, and means for supporting said pair of arms in their generally horizontally extending position.

2. A device as recited in claim 1 further comprising means for attaching portions of said arms remote from the open end thereof to said supporting means so that said arms may be swung 180° about a vertical axis.

3. A device as recited in claim 2 wherein said attaching means is vertically adjustable with respect to said supporting means whereby the vertical position of said arms may be adjusted.

4. A device as recited in claim 2 wherein said attaching means further comprise means for allowing adjustment of the horizontal position of said arms in a direction generally perpendicular to the direction of elongation of said arms.

5. A device as recited in claim 1 wherein said baseball supporting means is adjustable along the length of said lower arm to thereby adjust the position of a baseball supported thereby with respect to said arms.

6. A device as recited in claim 1 wherein said supporting means includes a vertically extending support member and a first base member for supporting said vertically extending member and adapted to be disposed on the ground, said base member including a first plate member having the same shape and diemsnions as a conventional baseball home-plate, and said base member being spaced horizontally from said vertical support member.

7. A device as recited in claim 6 further comprising means for attaching said arms to said vertical support member, said means including means for allowing adjustment of said arms in a horizontal direction perpendicular to the front edge of said firt plate member from positions on one side of said front edge to positions on the other side of said front edge and means for allowing adjustment of the vertical position of said arms with respect to said vertical member, and means for allowing adjustment of said ball supporting means along the direction of elongation of said lower arm from a position on one side edge of said first home-plate shaped base member.

8. A device as recited in claim 7 further comprising a second base member operatively attached to said vertical support member, said second base member also having the shape and dimensions as a conventional baseball home-plate and being spaced on the opposite side of said vertical support member from said first base member and having edges thereof parallel to corresponding edges of said first base member and orientated in the same direction, and means for operatively connecting said arms to said vertical support member so that said arms may be rotated 180° about said vertical support member whereby said device may be used by either a right-handed or left-handed batter.

9. A device as recited in claim 8 wherein said means for operatively connecting said arms to said vertical support member includes a sleeve member for surrounding a portion of said vertical support member, and means for maintaining said sleeve member in a particular vertical and rotative position with respect to said vertical support member.

10. A device as recited in claim 7 wherein said means for allowing adjustment of said arms in a direction perpendicular to the front edge of said first plate member includes a plate member having a horizontally extending groove therein and means connected to said arms for cooperation with said groove, and wherein said groove includes an enlarged portion thereof for allowing detachment of said arms from said plate member.

* * * * *